US009925652B2

(12) United States Patent
Foser et al.

(10) Patent No.: US 9,925,652 B2
(45) Date of Patent: Mar. 27, 2018

(54) MAGAZINE ATTACHMENT AND FASTENING SYSTEM

(71) Applicant: Hilti Aktiengesellschaft, Schaan (LI)

(72) Inventors: Thomas Foser, Balzers (LI); Urs Bruhin, Wangen (CH)

(73) Assignee: Hilti Aktiengesellschaft, Schaan (LI)

( * ) Notice: Subject to any disclaimer, the term of this patent is extended or adjusted under 35 U.S.C. 154(b) by 657 days.

(21) Appl. No.: 14/405,471

(22) PCT Filed: May 22, 2013

(86) PCT No.: PCT/EP2013/060476
§ 371 (c)(1),
(2) Date: Dec. 4, 2014

(87) PCT Pub. No.: WO2013/182421
PCT Pub. Date: Dec. 12, 2013

(65) Prior Publication Data

US 2015/0151418 A1 Jun. 4, 2015

(30) Foreign Application Priority Data

Jun. 4, 2012 (DE) ..... 10 2012 209 416

(51) Int. Cl.
*B25B 23/04* (2006.01)
*B25B 23/06* (2006.01)
(Continued)

(52) U.S. Cl.
CPC ..... *B25C 1/001* (2013.01); *B25B 23/045* (2013.01); *B25B 23/06* (2013.01); *B25B 23/08* (2013.01); *B25C 1/184* (2013.01)

(58) Field of Classification Search
CPC .. B25C 1/005; B25C 1/00; B25C 1/18; B25B 23/04; B25B 23/06; B25B 23/08
(Continued)

(56) References Cited

U.S. PATENT DOCUMENTS 1,726,012 A * 8/1929 Bilz ..... B25C 1/02 227/147
3,106,136 A * 10/1963 Langas ..... B25C 1/041 173/169

(Continued)

FOREIGN PATENT DOCUMENTS

DE 20 2011 022 771 U1 4/2011
DE 10 2012 209 416 A1 12/2013

(Continued)

OTHER PUBLICATIONS

International Search Report, Application No. PCT/EP2013.060476 dated Sep. 23, 2013.

*Primary Examiner* — Andrew M Tecco
*Assistant Examiner* — Praachi M Pathak
(74) *Attorney, Agent, or Firm* — Leydig Voit & Mayer

(57) ABSTRACT

Disclosed is a magazine attachment for a device for driving fastening elements into a support, comprising an attachment part which has a connecting region for connecting the magazine attachment to the device, and a pressing part which has a contact region for placing the magazine attachment against the support. The attachment part and the pressing part are held together in such a way as to be movable along a movement path which is delimited by a normal position and a pressing position. An outer contour of the pressing part has three contact points which define two half-lines forming a right angle. In the normal position and in the pressing position, the attachment part and the pressing part are entirely located within a volume formed by the right angle and a straight line that intersects the two half-lines at the vertex of the right angle.

16 Claims, 4 Drawing Sheets

Figure 1:
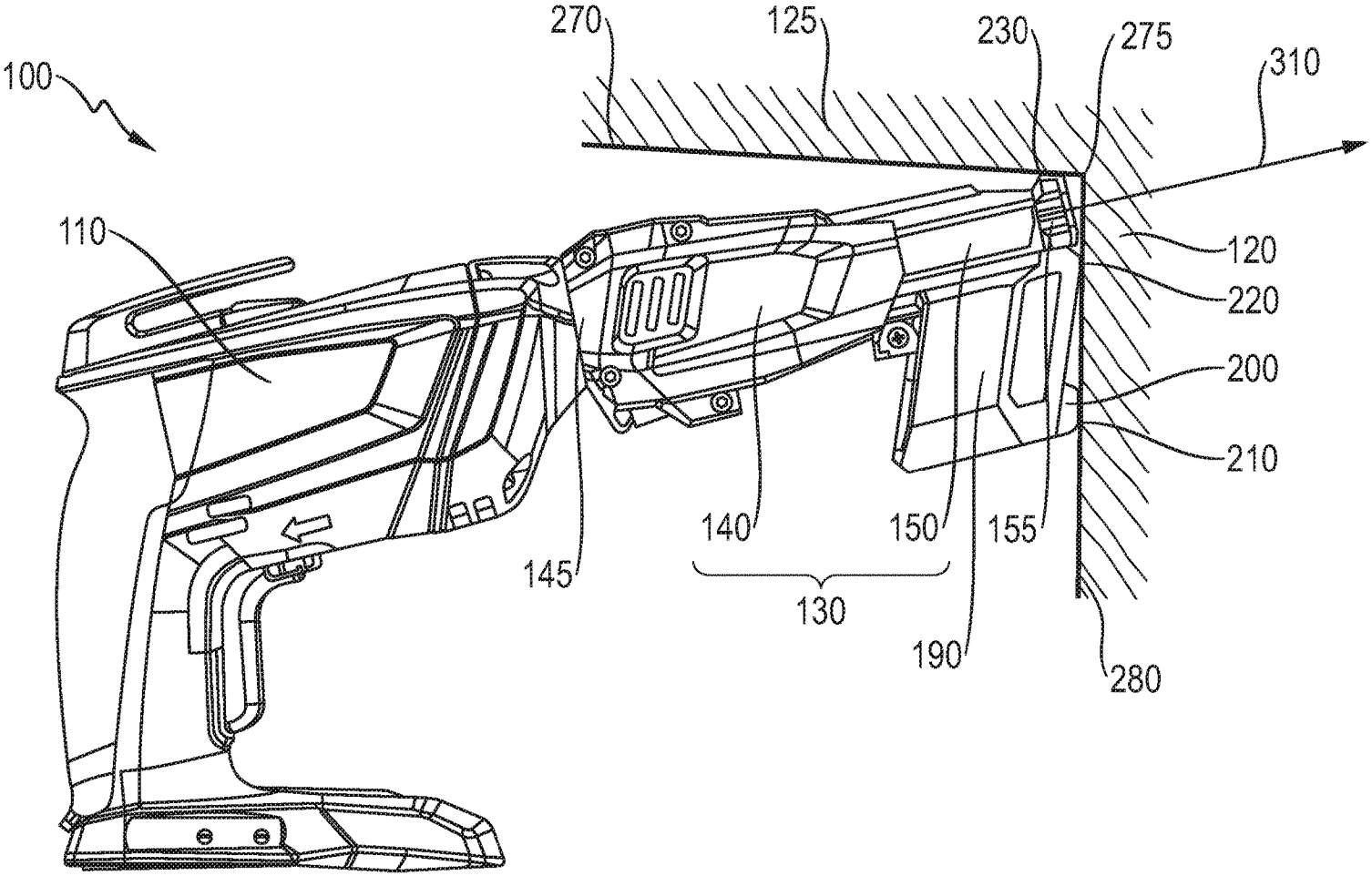

(51) Int. Cl.
*B25B 23/08* (2006.01)
*B25C 1/00* (2006.01)
*B25C 1/18* (2006.01)

(58) Field of Classification Search
USPC ..... 227/120
See application file for complete search history.

(56) References Cited

U.S. PATENT DOCUMENTS 3,360,176 A * 12/1967 Gehl ..... B25C 7/00 227/148
3,670,941 A * 6/1972 Grinnell ..... B25C 7/00 227/110
3,762,620 A * 10/1973 Geist ..... B25C 1/008 227/8
3,774,833 A * 11/1973 Deshich ..... B27F 7/02 227/100
3,786,980 A 1/1974 Passer
4,196,833 A * 4/1980 Haytayan ..... B25C 1/041 173/15
4,197,974 A * 4/1980 Morton ..... B25C 1/005 227/120
4,346,831 A * 8/1982 Haytayan ..... B25C 1/001 227/130
4,389,012 A * 6/1983 Grikis ..... B25C 1/005 221/198
4,566,619 A * 1/1986 Kleinholz ..... B25C 1/044 173/210
4,566,621 A * 1/1986 Becht ..... B25C 1/06 227/109
4,581,964 A * 4/1986 Takatsuru ..... B25C 1/003 227/120
4,630,766 A * 12/1986 Steeves ..... B25B 31/00 227/113
4,867,366 A * 9/1989 Kleinholz ..... B25C 1/044 173/210
5,054,678 A * 10/1991 Nasiatka ..... B25C 7/00 227/120
5,165,827 A * 11/1992 Miller ..... B25H 1/0042 408/110
5,261,588 A * 11/1993 Lin ..... B25C 7/00 227/110
5,628,445 A * 5/1997 Braddock ..... B25C 7/00 227/120
5,810,239 A * 9/1998 Stich ..... B25C 7/00 227/119
6,036,072 A * 3/2000 Lee ..... B25C 1/005 227/120
6,161,744 A * 12/2000 Mukoyama ..... B25H 3/006 227/120
6,631,836 B2 * 10/2003 Dickhaut ..... B25C 7/00 227/128
7,070,079 B2 * 7/2006 Smolinski ..... B25C 7/00 227/142
7,575,140 B2 * 8/2009 Jiang ..... B25C 7/00 227/110
7,870,987 B1 * 1/2011 Zhang ..... B25C 1/008 227/107
8,181,712 B2 * 5/2012 Liu ..... B25C 1/001 173/1
8,186,554 B2 * 5/2012 Abla ..... B25C 1/00 227/148
8,485,410 B1 * 7/2013 Harshman ..... B25C 1/001 227/120
9,527,196 B2 * 12/2016 Segura ..... B25C 1/005
9,649,756 B1 * 5/2017 Litzinger ..... B25C 7/00
2002/0100787 A1 * 8/2002 Lin ..... B25C 1/003 227/8
2004/0050900 A1 * 3/2004 Caringella ..... B25C 1/184 227/120
2005/0224379 A1 10/2005 Pally et al.
2006/0196682 A1 * 9/2006 McGee ..... B25C 1/041 173/1
2007/0102440 A1 5/2007 Matthiesen et al.
2007/0215668 A1 * 9/2007 Tabacco ..... B25C 7/00 227/107
2008/0257932 A1 * 10/2008 Nagata ..... B25C 1/184 227/120
2009/0084823 A1 * 4/2009 Tanji ..... B25C 1/003 227/8
2009/0242608 A1 * 10/2009 Dittrich ..... B25C 5/16 227/120
2009/0266867 A1 * 10/2009 Mina ..... B25C 7/00 227/151
2010/0308098 A1 * 12/2010 Francis ..... B25C 1/047 227/148
2015/0151418 A1 * 6/2015 Foser ..... B25B 23/045 227/120

FOREIGN PATENT DOCUMENTS

EP 1 537 953 A2 6/2005
EP 1 785 232 A2 5/2007

* cited by examiner

MAGAZINE ATTACHMENT AND FASTENING SYSTEM

FIELD OF THE INVENTION

The invention concerns a magazine attachment for a device for driving fastening elements into a support and a fastening system with such a magazine attachment and such a device.

BACKGROUND OF THE INVENTION

Such magazine attachments usually comprise two parts that are held so they can move toward one another, namely, an attachment part for connecting the magazine attachment with the device and a pressing part for pressing the device to the support, which are pushed together during the pressing. In the corners of a room, the fastening elements are not always driven vertically into the support; rather, the pressing part is pressed at an angle against a first of the two walls forming the individual corner of the room and thereby touches the other second wall, so as to attain a fastening that is as close as possible to the corner of the room. If, during the pressing, the attachment part is then pushed onto the pressing part, the attachment part is pushed away from the second wall, so that the entire magazine attachment and thus the driving direction of a driving element tilt during the driving procedure. It is possible for the driving element to then slip off of the fastening element, wherein the fastening quality suffers.

SUMMARY OF THE INVENTION

It is a goal of the invention to make available a magazine attachment with which the fastening quality is improved, in particular in the vicinity of the corners of a room.

The goal is attained by a magazine attachment for a device to drive fastening elements into a support with an attachment part that has a connecting area to connect the magazine attachment with the device and with a pressing part that has a contact region to place the magazine attachment on the support, wherein the attachment part and the pressing part are held so they can move toward one another along a movement path, wherein the movement path is delimited by a normal position and a pressing position, wherein an outer contour of the pressing part has three contact points, which define two half-lines spanning a right-angle angular field, and wherein the attachment part and the pressing part in the normal position and in the pressing position are located completely within a volume that is spanned by the angular field and a line preferably vertically intersecting the two half-lines at the vertex of the angular field. If the magazine attachment in accordance with the invention is pressed against a wall in a corner of the room, the three contact points are adjacent to the two walls defining the corner of the room, so that the volume is equal to the space between the two walls. Thus, the attachment part does not push against one of the two walls during the driving procedure and permits a driving without tilting.

One preferred embodiment is characterized in that the movement path is linear and defines a driving direction that is oriented within the angular field and is inclined relative to the two half-lines spanning the angular field. With particular preference, the driving direction is inclined relative to a first of the two half-lines by an angle between 5° and 30° and relative to a second of the two half-lines by an angle between 60° and 85°.

One preferred embodiment is characterized in that the attachment part has a guide in which the pressing part can be moved in along the movement path. An alternative embodiment is characterized in that the pressing part has a guide into which the attachment part can be moved in along the movement path.

One preferred embodiment is characterized in that two of the three contact points are situated at a distance between them of at least 8 mm on one of the two half-lines. With particular preference, the distance between them is at least 40 mm. One preferred embodiment is characterized in that the third contact point is situated at a distance of at least 5 mm from the vertex. With particular preference, this distance is at least 10 mm. One preferred embodiment is characterized in that at least one of the three contact points is situated at a distance of at least 30 mm from the vertex. With particular preference, this distance is at least 60 mm.

One preferred embodiment is characterized in that the outer contour of the pressing part has three additional contact points, which define two other half-lines, spanning an additional right-angle angular field, and wherein the attachment part and the pressing part in the normal position and in the pressing position are situated completely within the volume spanned by the additional angular field and a line intersecting the two additional half-lines at the vertex of the additional angular field, and wherein the angular field and the additional angular field define planes inclined toward one another, in particular planes that are at right angles relative to one another.

One preferred embodiment is characterized in that the pressing part has a holder for a fastening element and a passage for a driving element placed on the device, with the aid of which a fastening element in the holder can be driven into the support. One preferred embodiment is characterized in that the pressing part has a feedthrough for a fastening element and a transport mechanism, with the aid of which a fastening element can be transported into the holder along the feedthrough, if the pressing part is moved relative to the attachment part, from the normal position into the pressing position. One preferred embodiment is characterized in that the connection area is suitable for the fastening of the attachment part to a holder lining for driving elements of the device.

In accordance with a preferred embodiment, the magazine attachment, together with the device, forms a fastening system wherein the connecting area of the attachment part can be connected with the device. One preferred embodiment is characterized in that the device in the normal position and in the pressing position of the magazine attachment is situated completely within the volume spanned by the angular field and a line intersecting the two half-lines at the vertex of the angular field.

BRIEF DESCRIPTION OF THE SEVERAL VIEWS OF THE DRAWING(S)

Figure 2:
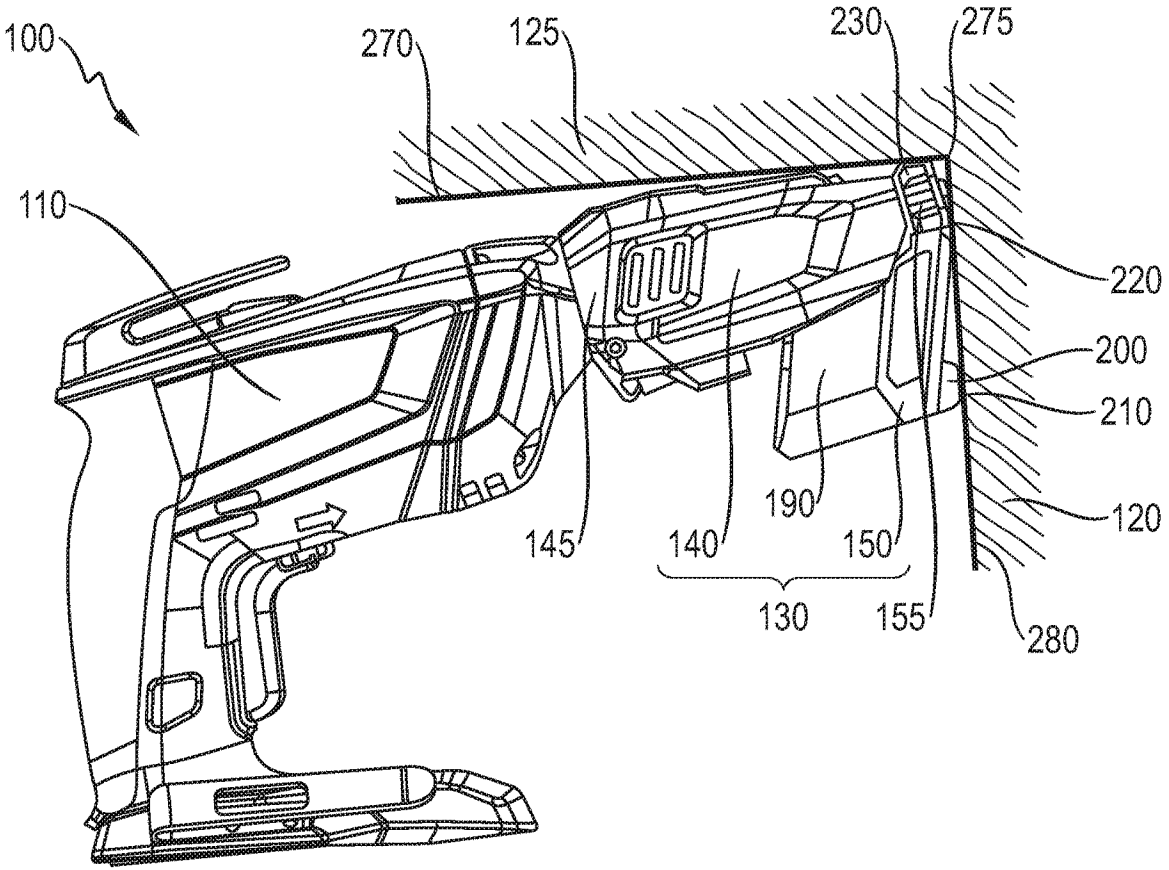
Figure 3:
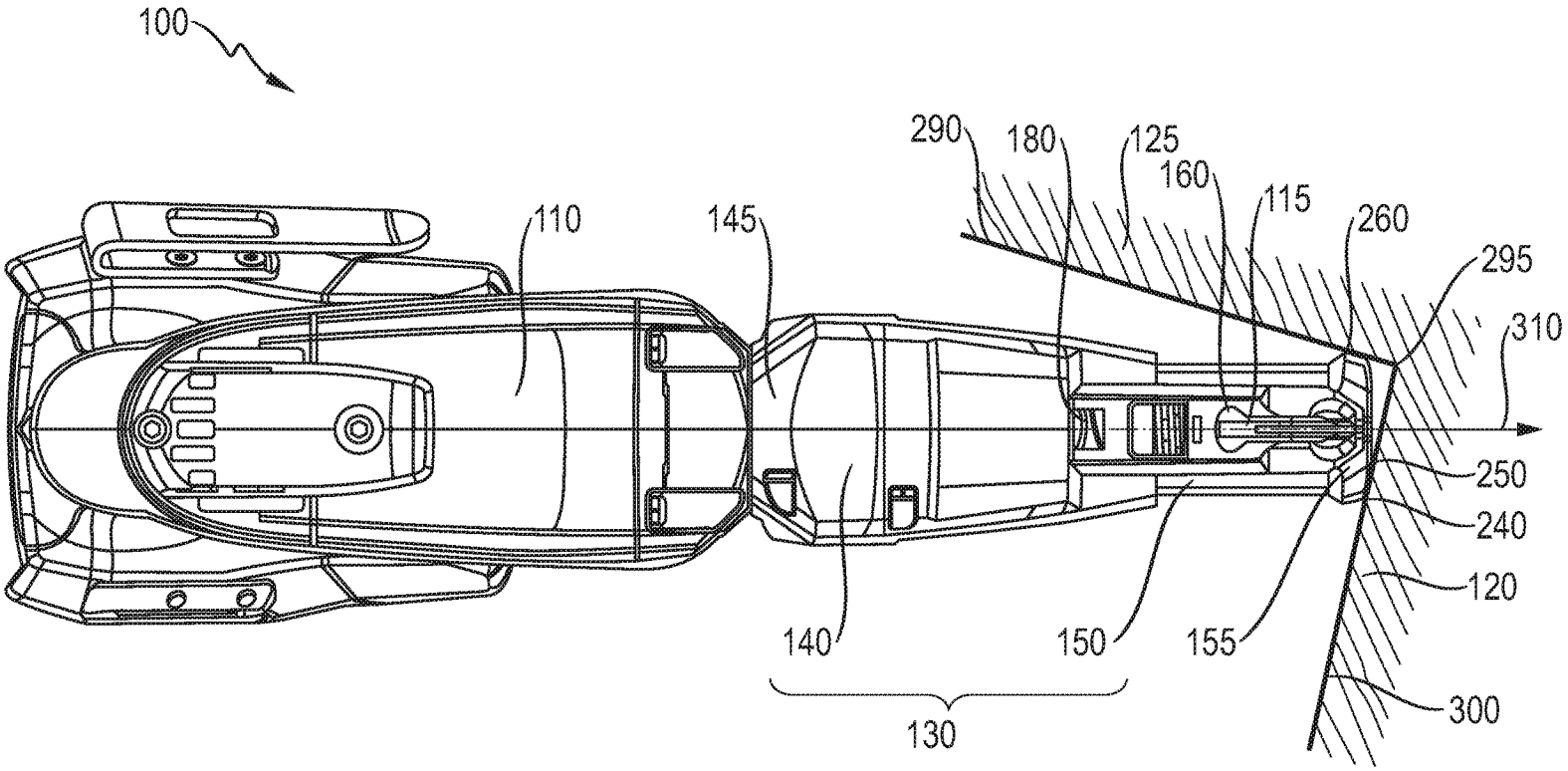
Figure 4:
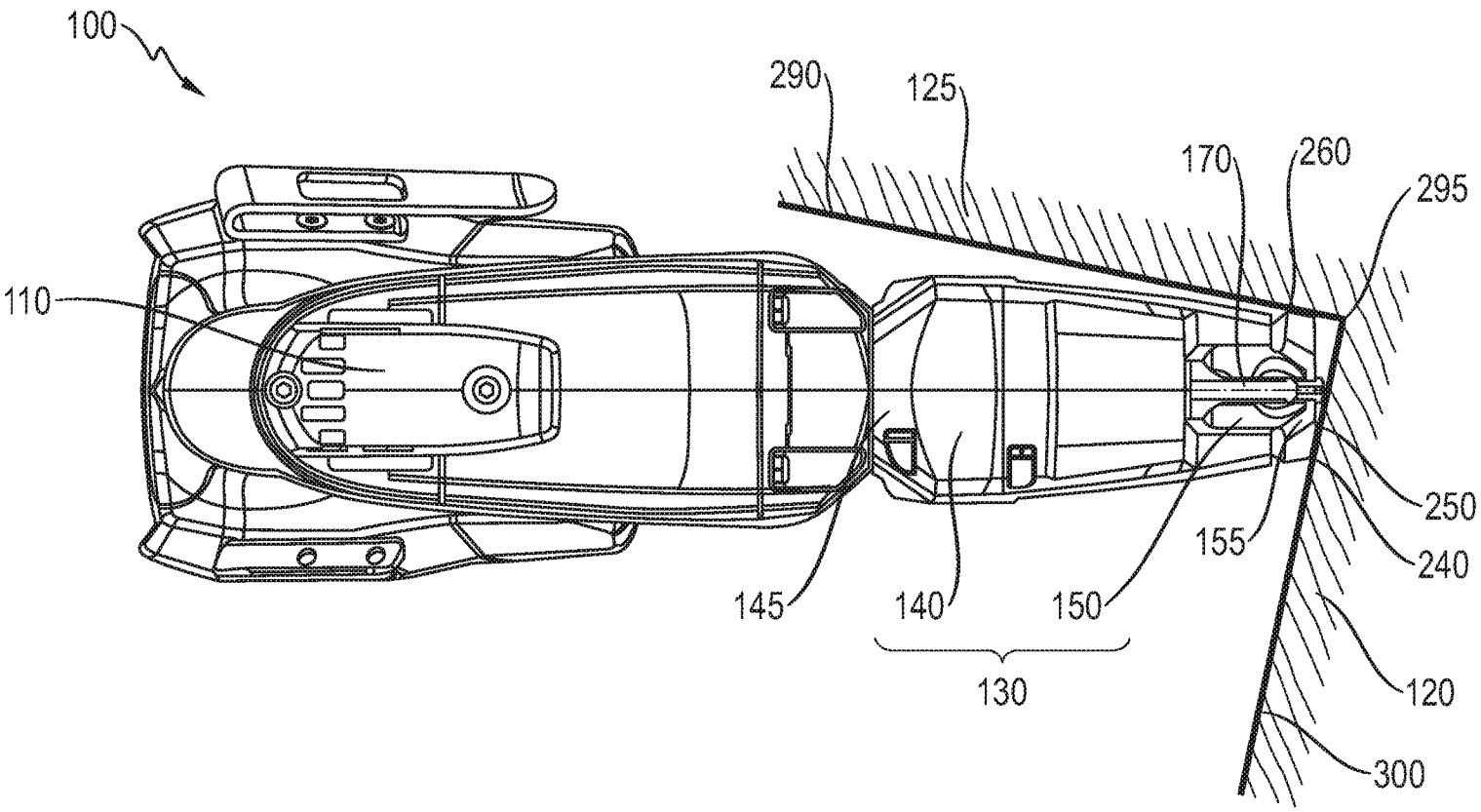

Preferred embodiment examples are explained in more detail below, with reference to the drawings. The figures show the following:

FIG. 1, a fastening system in a normal position from a first perspective;

FIG. 2, the fastening system in a pressing position in the first perspective;

FIG. 3, the fastening system in the normal position from a second perspective; and FIG. 4, the fastening system in the pressing position from the second perspective.

DETAILED DESCRIPTION OF THE INVENTION

The figures show a fastening system 100 from a first perspective (FIGS. 1 and 2) and from a second perspective that is vertical relative to the first (FIGS. 3 and 4). The fastening system 100 comprises a device 110, designed as a cordless screwdriver for the driving of fastening elements 115 designed as screws into a support 120, and a magazine attachment 130. The magazine attachment comprises, in turn, an attachment part 140 with a connecting area 145 to connect the magazine attachment 130 with the device 110 and a pressing part 150 with a contact region 155 to place the magazine attachment 130 on the support 120. The pressing part 150 has a holder 160 for the fastening element 115 and a passage, which is not depicted, for a driving element 170 that is designed, for example, as a screwdriver. The driving element 170 is fastened in a non-depicted holder lining of the device 110, in a replaceable manner, and is driven in a rotating manner by the device 110 in order to drive the fastening element 115 from the holder 160 into the support 120. The fastening elements 115 are designed as screws in the embodiment example under consideration. In the non-depicted examples, the fastening elements are designed as screw braces, bolts, stud attachments, nails, rivets, or the like, and are driven into the support in a rotating or linear manner.

The attachment part 140 has a guide in its interior, into which the pressing part 150, designed like a track, can be driven along a movement path. In non-depicted embodiment examples, the pressing part has a guide into which the pressing part can be driven. The movement path extends thereby from a normal position (FIGS. 1 and 3) to a pressing position (FIGS. 2 and 4). The attachment part 140 and the pressing part 150 are held next to one another in such a manner that they cannot be moved farther away from one another or closer to one another than up to these two end positions and along the entire movement path, including the two end positions. A pressing spring 180, situated in the guide, is compressed during the pressing of the magazine attachment 130 on the support 120 and ensures that the attachment part 140 and the pressing part 150 are moved into the normal position when the magazine attachment 130 is lifted from the support 120. The magazine attachment 130 also comprises a magazine guide 190 to supply the fastening elements 115 into the holder 160 and a transport mechanism, which is not depicted in more detail, for the transport of the fastening elements 115 or a magazine strip carrying the fastening elements 115, wherein the transport mechanism is actuated, for example, by a pressing of the magazine attachment 130 on the support 120 and/or by a lifting of the magazine attachment 130 from the support 120. The pressing part 150, moreover, has a support foot 200 situated on the magazine guide 190 to support the magazine attachment 130 on the support 120.

The outer contour of the pressing part 150 has support points 210, 220, 230, which define two half-lines 270, 280. The half-lines 270, 280 have an intersection point 275 and span a right-angle angular field between them in the drawing plane of FIGS. 1 and 2 that along with a line running through the intersection point 275 and vertically intersecting the half-lines 270, 280 span a volume that is just delimited by the support 120 and a side wall 125 perpendicular to it, if the support points 210, 220, 230 in the arrangement shown in FIGS. 1 and 2 are placed on the support 120 or the side wall 125. The attachment part 140, the pressing part 150, and the device 110, in the normal position and in the pressing position, are situated completely within this spanned volume, so that the entire fastening system 100 again pushes neither the support 120 nor against the side wall 125 during the pressing on the support 120, that is, during the entire driving procedure, and thus permits a driving free of tilting. In order to facilitate this to the user of the fastening system 100, the support points 210, 220, 230 are situated as far apart from one another and from the intersection point 275 as is possible, and preferably extend one-dimensionally as edges or, with particular preference, two-dimensionally as surfaces. In the depicted embodiment example, the support point 210 has a distance of 56 mm from the support point 220 and a distance of 70 mm from vertex 275. The support point 230 has a distance of 10 mm from the vertex 275. The movement path is linear and defines the driving direction 310 of the fastening elements, which is oriented within the angular field and is inclined relative to the half-lines 270 by 80° and thus, relative to the half-line 280 by 10°.

The outer contour of the pressing part 150 has additional support points 240, 250, 260, which define additional half-lines 290, 300. The additional half-lines 290, 300 have an intersection point 295 and span between them an additional right-angle angular field in the drawing plane of FIGS. 3 and 4 that along with a line running through the intersection point 295 and vertically intersecting the additional half-lines 290, 300 span a volume that is just delimited by the support 120 and a side wall 125 perpendicular to it, if the additional support points 240, 250, 260 in the arrangement shown in FIGS. 3 and 4 are placed on the support 120 or the side wall 125. The attachment part 140, the pressing part 150, and the device 110 in the normal position and in the pressing position are also situated here completely within this spanned volume, so that the entire fastening system 100 is pushed neither against the support 120 nor against the side wall 125 during the pressing on the support 120, that is, during the entire driving procedure, and thus permits a driving free of tilting. In the embodiment example shown, the additional support point 240 has a distance of 8 mm from the additional support point 250 and a distance of 32 mm from the vertex 295. The additional support point 260 has a distance of 10 mm from the vertex 295. The additional angular field thereby defines a plane (the drawing plane of FIGS. 3 and 4) that is perpendicular to the plane defined by the angular field (the drawing plane of FIGS. 1 and 2). The driving direction 310 of the fastening elements is oriented, in turn, within the angular field and is inclined relative to the half-line 290 by 80° and thus, relative to the half-line 300 by 10°.

The invention under consideration was shown by using the example of a magazine attachment for a driving device. However, it should be pointed out that the magazine attachment in accordance with the invention is also suitable for other application purposes.

The invention claimed is:

1. A magazine attachment for a device to drive fastening elements into a first wall, the magazine attachment comprising an attachment part having a connecting area to connect the magazine attachment with the device, and a pressing part having a support region to place the magazine attachment in contact with the first wall and a second wall, wherein the first wall and the second wall are perpendicular to each other, defining a right-angle angular field between them, the first wall providing a first half-line and the second wall providing a second half-line, the first and the second half-lines contacting each other at a vertex and spanning the right-angle angular field, the support region having an outer contact region for contacting the first wall and the second wall; wherein the attachment part and the pressing part are held next to one another so they can move along a movement path, wherein the movement path is delimited by a normal position and a pressing position, wherein the outer contact region of the support part has three support points, each of the three support points for contacting the first wall or the second wall, and wherein the attachment part and the pressing part, when in the normal position and in the pressing position, are situated completely within the right-angle angular field.

2. The magazine attachment of claim 1, wherein the attachment part and the pressing part, when in the normal position and in the pressing position, are situated completely within the right-angle angular field and a line vertically intersecting the first and second half-lines at the vertex.

3. The magazine attachment of claim 2, wherein the movement path is linear and defines a driving direction that is oriented within the right-angle angular field and is inclined relative to the first and second half-lines spanning the right-angle angular field.

4. The magazine attachment of claim 1, wherein the movement path is linear and defines a driving direction that is oriented within the right-angle angular field and is inclined relative to the first and second half-lines.

5. The magazine attachment of claim 4, wherein the driving direction is inclined relative to a first of the first and second half-lines by an angle between 5° and 30°, and relative to a second of the first and second half-lines by an angle between 60° and 85°.

6. The magazine attachment of claim 1, wherein two of the three contact points are situated at a distance between them of at least 8 mm on one of the first and second half-lines.

7. The magazine attachment of claim 6, wherein two of the three contact points are situated at a distance between them of at least 40 mm, on one of the two half-lines.

8. The magazine attachment of claim 1, wherein the third contact point is situated at a distance of at least 5 mm from the vertex.

9. The magazine attachment of claim 8, wherein the third contact point is situated at a distance of at least 10 mm from the vertex.

10. The magazine attachment of claim 1, wherein at least one of the three contact points is situated at a distance of at least 30 mm from the vertex.

11. The magazine attachment of claim 10, wherein at least one of the three contact points is situated at a distance of at least 60 mm from the vertex.

12. The magazine attachment of claim 1, wherein the outer contour of the pressing part has three additional contact points, which define additional first and second half-lines spanning an additional right-angle angular field having a vertex, and wherein the attachment part and the pressing part, when in the normal position and in the pressing position, are situated completely within the additional right-angle angular field and a line intersecting the additional first and second half-lines at the vertex of the additional right-angle angular field, and wherein the right-angle angular field and the additional right-angle angular field define planes that are inclined toward one another.

13. The magazine attachment of claim 12, wherein the right-angle angular field and the additional right-angle angular field define planes that have right angles relative to one another.

14. The magazine attachment of claim 1, wherein the pressing part has a feedthrough for a fastening element and a transport mechanism, with the aid of which a fastening element can be transported along the feedthrough into a holder if the pressing part is pushed relative to the attachment part from the normal position into the pressing position and/or vice versa.

15. A fastening system comprising a device to drive fastening elements into a support and the magazine attachment according to claim 1, wherein the connecting area can be connected with the device.

16. The fastening system of claim 15, wherein when the device is in the normal position and in the pressing position, the magazine attachment is situated completely within the right-angle angular field.

* * * * *